United States Patent [19]

Croft et al.

[11] 4,065,251

[45] Dec. 27, 1977

[54] FURNACES

[75] Inventors: Edward Francis Beverley Croft, Aldridge; John J. Lane, Weston-super-Mare, both of England

[73] Assignee: Associated Electrical Industries Limited, London, England

[21] Appl. No.: 711,236

[22] Filed: Aug. 3, 1976

[51] Int. Cl.[2] ..... F27B 9/28

[52] U.S. Cl. ..... 432/59; 432/144; 432/145; 34/155; 34/233; 266/111; 266/251

[58] Field of Search ..... 432/8, 59, 58, 143, 432/144, 152, 176, 185, 199, 230, 145, 21; 34/155, 156, 233, 225; 266/111, 251; 431/115, 116

[56] References Cited

U.S. PATENT DOCUMENTS

| | | | |
|---|---|---|---|
| 982,665 | 1/1911 | Gantvoort | 432/144 |
| 1,948,173 | 2/1934 | Hagen | 432/58 |
| 2,136,993 | 11/1938 | Palmgren | 34/233 |
| 2,181,928 | 12/1939 | Vaughan | 432/145 |
| 2,214,157 | 9/1940 | Bannister | 432/8 |
| 2,795,054 | 6/1957 | Bowen | 432/8 |
| 3,100,632 | 8/1963 | Mohring | 432/145 |
| 3,513,813 | 5/1970 | Towson et al. | 431/116 |
| 3,522,936 | 8/1970 | Geipel et al. | 432/59 |
| 3,550,922 | 12/1970 | Geipel | 432/58 |
| 3,604,824 | 9/1971 | Hardison | 34/155 |
| 3,614,074 | 10/1971 | Wellford, Jr. | 432/176 |
| 3,997,317 | 12/1976 | Dicks | 432/145 |

*Primary Examiner*—John J. Camby
*Assistant Examiner*—Henry C. Yuen
*Attorney, Agent, or Firm*—Bacon & Thomas

[57] ABSTRACT

A furnace for heating one or more bodies in which heated gas is introduced into the furnace chamber through one or more injectors and are conveyed to the bodies in a manner involving appreciable resistance to gas flow. In a preferred arrangement a continuous metal strip is conveyed through the furnace on a gaseous support cushion, the gas being introduced into the furnace under pressure through injectors which communicate with the lower portion of the furnace. The injectors generate a substantial recirculation of gas within the furnace.

16 Claims, 7 Drawing Figures

Figure 1:
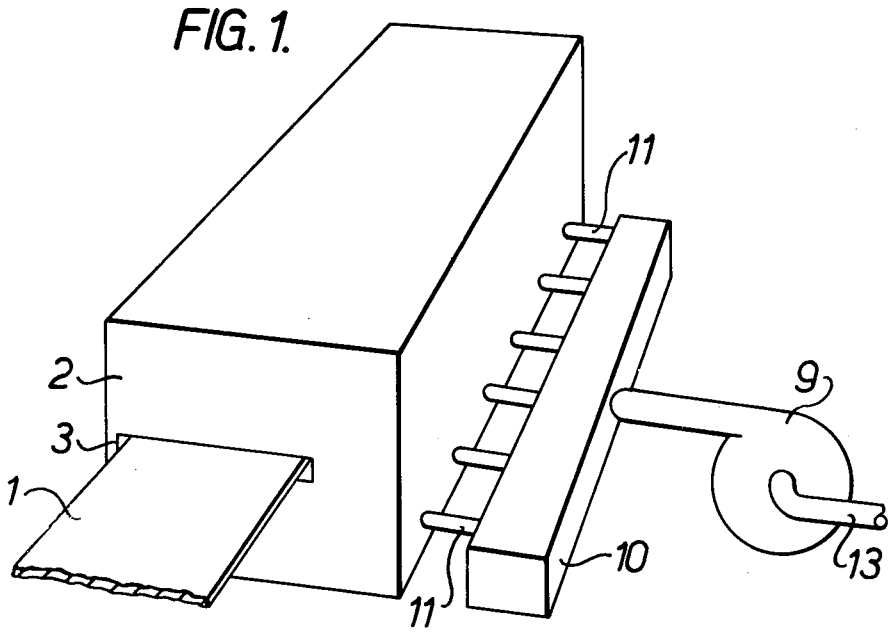

FIG. 3.
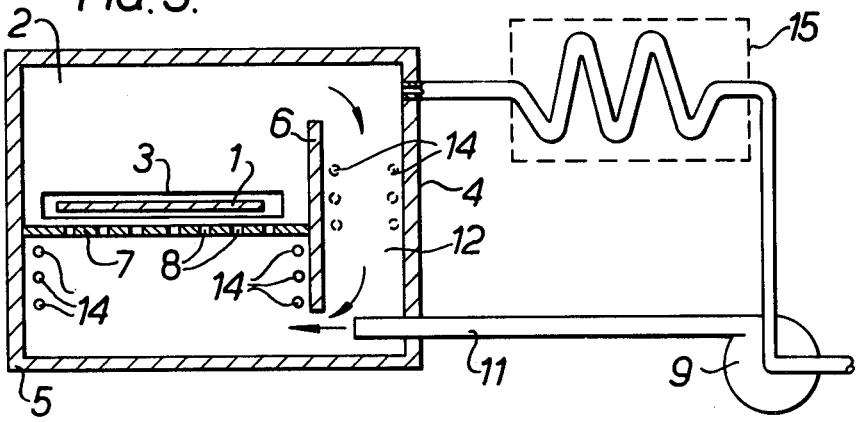
FIG. 4.
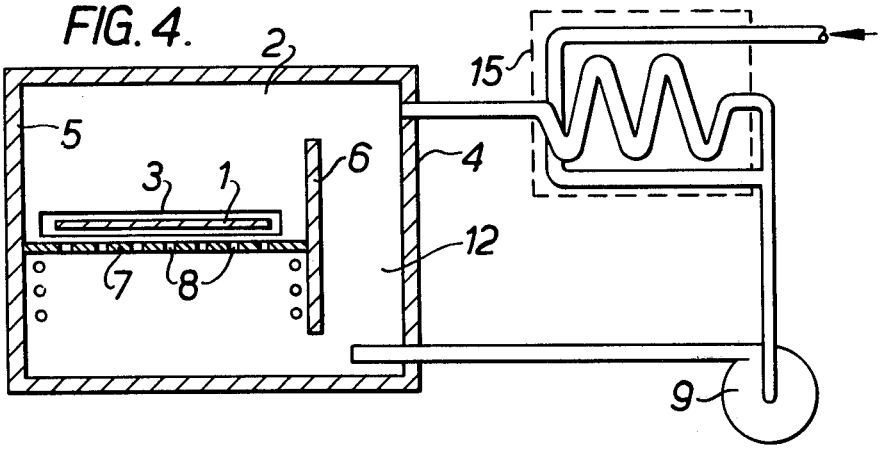
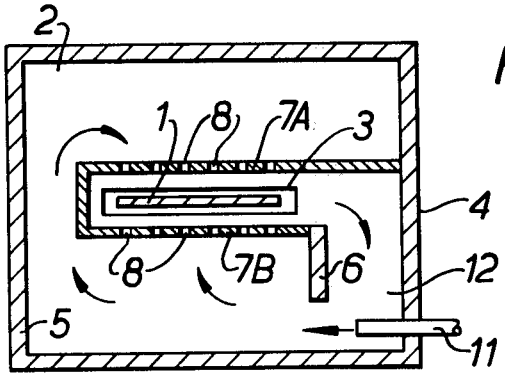
FIG. 5.

FURNACES

This invention relates to furnaces for heating metal strip or sheet material, hereinafter referred to simply as strip.

Where a metal strip is required to be heated to a high temperature, involving a large volume flow of the gas, thermal losses may be considerable, and whilst recirculation of the gas may in some cases provide a way of reducing such thermal losses to some extent, practical difficulties have previously limited the usefulness of this technique. Thus for some applications the gas may have to negotiate restricted passages providing an appreciable resistance to gas flow, and high power blowers, compressors, or like devices may therefore be needed to impart sufficient pressure energy into the system in order to obtain the required circulation. However there is a limit to the temperature at which such devices as are currently available can operate satisfactorily at least for prolonged periods.

According to the present invention, a furnace for the continuous heat treatment of metal strip, in which the strip is supported on a gaseous cushion as it travels through the furnace comprises a furnace chamber including a lengthwise-extending strip support surface, a plurality of inspectors for feeding gas under pressure into the furnace chamber so as to promote rapid recirculation of at least a major proportion of the gas contained in the furnace chamber and means for directing recirculating gas over the strip support surface to provide a gaseous cushion between said support surface and metal strip travelling through the furnace.

Preferably, the gas introduced into the furnace is dense to minimise the volume required to support the strip. Light gases such as hydrogen can be employed that would entail the use of large gas volumes. Additionally, the gas may be selected to provide a protective or reducing atmosphere within the furnace chamber. In one example the gas comprises a mixture of argon and hydrogen and in another a mixture of nitrogen and hydrogen.

The furnace chamber may include a plurality of transverse baffles which divide the lower part of the chamber into a number of compartments, into each of which is fed gas under pressure; the rate of flow of gas into each compartment may be controlled independently of the rate of flow into the other compartments thereby enabling the degree of floatation of the strip at any region of the furnace to be adjusted as desired.

This is of advantage, for example, during the threading of strip through the furnace, or when a change of strip thickness is passed through it, as well as when local difficulties are experienced with floatation for reasons of strip, furnace or gas flow deterioration.

In some cases, different gases or gases at different temperatures may be fed into the furnace either through the same or different injector means, and with such an arrangement the rates of flow may be controlled, for example, so as to produce a variation in the proportions of the constituents at different parts of the furnace or on a time basis.

Figure 2:
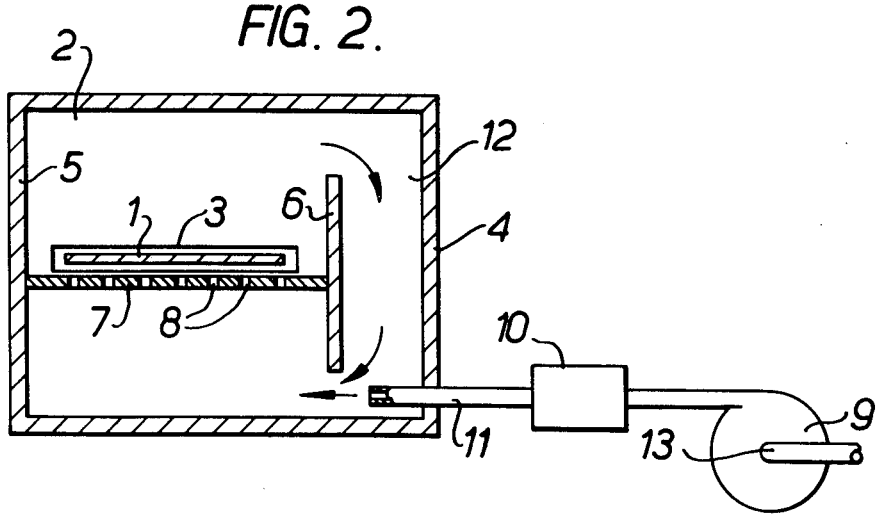
Figure 6:
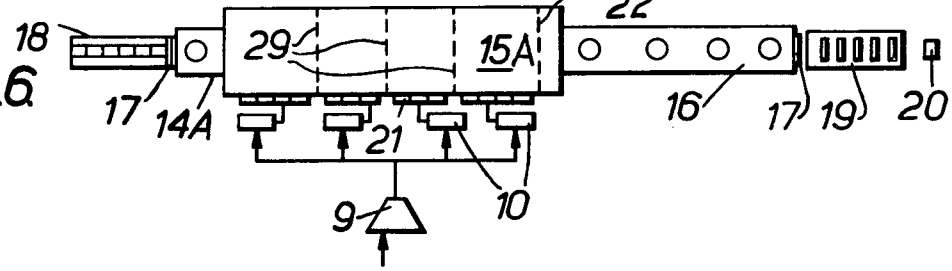
Figure 7:
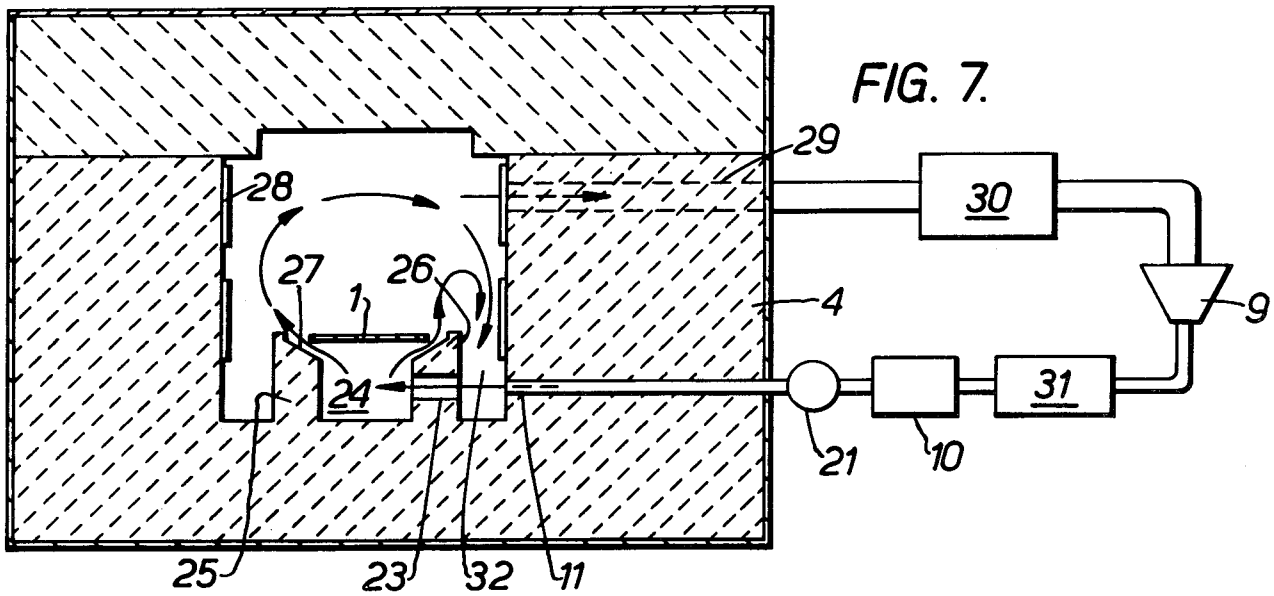

A number of furnaces in accordance with the invention will now be described by way of example with reference to FIGS. 1 to 7 of the accompanying schematic drawings, in which:

FIGS. 1 and 2 illustrate in diagrammatic form a perspective view and a transverse cross-section through the first furnace, FIG. 3 illustrates, also in diagrammatic form, a transverse section through the second furnace, FIG. 4 shows a modified form of the furnace illustrated in FIG. 3, FIG. 5 illustrates a transverse section through a further form of furnace, and FIGS. 6 and 7 are respectively a plan and a transverse section through a still further form of furnace.

Referring first to FIGS. 1 and 2, the furnace illustrated therein is designed to heat a continuously moving metal strip 1 and comprises an elongated chamber 2 through which the strip is fed substantially horizontally, the furnace being closed apart from narrow horizontal slots 3 at its two ends for the passage of the strip into and from the chamber.

Between the two side walls 4,5 of the furnace there is located an internal wall 6 which extends the length of the furnace adjacent the wall 4, the internal wall 6 and the other side wall 5 defining the furnace chamber and supporting between them a horizontal plate 7 formed with a multiplicity of openings 8, the plate being slightly lower than the slots 3 as shown in FIG. 2.

The strip is designed to be heated by a gas, or gas mixture fed into chamber by a suitable blower 9, means of any convenient kind being provided for heating the gas to an appropriate temperature, either between the blower and the chamber as shown at 10 or alternatively after its entry into the chamber.

The gas is arranged to be introduced into the lower part of the furnace under pressure through a plurality of injectors 11 spaced along the side 4 of the furnace so that they direct the gas into the furnace chamber between the walls 5,6, the pressure of the gas being such that it is forced upwards through the openings 8 in the plate 7 which cause it to be directed in the form of jets on to the lower surface of the strip 1.

In addition the rate at which gas is injected into the furnace produces a pressure drop in the vicinity of the injectors 11 sufficient to cause gas, after heating the strip 1, to be recirculated at a high rate from the upper to the lower part of the chamber through the passage 12 provided between the internal wall 6 and the adjacent side wall 4. By causing gas to be circulated within the furnace in this manner thermal losses can be considerably reduced, and the need for locating the blower in the recirculating flow path is avoided.

Some gas will escape from ends of the furnace, and losses are made up by fresh gas fed to the blower 9 through inlet 13.

In the second furnace illustrated in FIG. 3 the external heating means 10 is replaced by internal heaters, for example electrical resistance heating elements 14, conveniently fitted to the furnace walls 5,6 beneath the plate 7. In addition part of the gas from the upper part of the furnace chamber 2 is recirculated through the blower 9 thereby reducing the quantity of fresh and unheated nakeup gas required.

Since the temperature of the gas stream leaving the chamber 2 will normally be higher than that which can be reliably withstood by conventional forms of blowers a heat exchanger 15 is provided for cooling the gas between the chamber 2 and the blower 9.

Means (not shown) may be provided for varying the proportions of the recirculated and fresh gas fed into the furnace through the injectors 11.

Electric heating elements may additionally or alternatively be placed in the passage 12 as shown at 14. Other forms of heating can alternatively be employed, for example gas burners located within the lower part of the furnace chamber.

In the modification of this second furnace which is illustrated in FIG. 4 the heat exchanger 15 is used to raise the temperature of the fresh make-up gas before it is admitted to the blower 9, thereby reducing still further the thermal losses of the system.

In some cases it may be possible to dispense with the heat exchanger completely, fresh gas at a suitably low temperature being mixed with the recirculated gas in suitable proportions in order to cool it before it is returned to the blower.

Whilst, in the furnaces illustrated, the strip 1 is arranged to be fed through the furnace horizontally it may alternatively be fed through the furnace in a vertical or inclined plane, the furnace including the positioning of the injectors 11 being modified accordingly.

However, in cases where the strip is arranged to be fed horizontally or down a slight incline the pressure of the gas injected into the furnace may be such that in addition to heating the strip it also provides a cushion of pressurized gas which supports the strip on its passage through the furnace.

In such a case the lower part of the chamber of a furnace as shown in any of FIGS. 1 to 4 may be split into several compartments by a number of transverse vertical walls, (not shown), spaced apart a distance of the order of 2 or 3 feet, with their upper edges terminating just below the level of the slots 3, each of the compartments being associated with an individual injector 11. Such an arrangement prevents local floatation being seriously affected by a different situation existing elsewhere in the furnace, and allows the flow through a particular region to be adjusted, for example by controlling the flow of gas through a respective injector 11, or by throttling the appropriate region of the return duct 12 which can be divided into a number of separate sections by means of transverse walls (not shown).

In some cases, heated gas may be required to be directed in the form of jets on to both surfaces of the strip 1, and a furnace for achieving this is shown schematically in FIG. 5.

In this furnace the furnace chamber 2 accommodates a pair of horizontal jet plates 7A and 7B located above and below the slots 3, and so arranged that the heated gas from the injectors 11 is directed on to the upper and lower surfaces of the plates through the holes 8 in the plates 7A and 7B respectively, the rate at which gas is fed into the furnace through the injectors producing a recirculation of the gas from between the plates back into the main part of the furnace through the passage 12, where it is redirected on to the strip through the holes in the jet plates, in a manner similar to that of the furnaces illustrated in FIGS. 1 to 4.

The furnace illustrated in FIGS. 6 and 7 is again designed to heat a continuously moving metal strip 1 and comprises an elongate chamber 2 through which the strip is fed in a substantially horizontal or slightly downwardly inclined direction. More particularly, the furnace includes a water cooled entry zone 14A, a heating zone 15A and an exit cooling zone 16. Pressure seals 17 are provided at the entrance to and exit from the furnace in order to minimise gas losses to the atmosphere. Strip is fed to the furnace along a floatation table 18 and is withdrawn from the furnace over a roller table 19 by means of a pair of pinch rolls 20.

As described with reference to the previous embodiments, gas under pressure is fed into the heating zone 15A through the injectors 11, the gas being compressed in the blower 9 and fed via the heaters 10 to manifolds 21 in communication with the individual injectors.

The lower part of the heating zone 15A is split into several compartments by a plurality of spaced transverse vertical walls 22. The upper edges of the walls 22 terminate just below the level of the entry and exit ports of the furnace and each compartment is supplied with gas under pressure through an individual injector 11 or through a batch of injectors. This arrangement prevents local floatation being seriously affected by a different situation existing elsewhere in the furnace, and allows the flow through a particular region to be adjusted, for example by controlling the flow of gas through a respective injector 11.

As illustrated in FIG. 7 each injector 11 extends through one refractory lined side wall 4 of the furnace to discharge gas under pressure through an opening 23 formed in the furnace hearth into a plenum chamber 24. The hearth includes two vertical walls 25,26 provided at their upper ends with outwardly inclined lips 27 running horizontally along the full length of the furnace.

Electrical heating elements 28 are mounted on the side walls of the furnace chamber. Ducting 29 is provided in the upper portion of the side wall 4 to convey gas from the furnace chamber to an external gas circulation circuit which includes a cooler 30, the blower 9, a dryer 31, heaters 10 and injector manifolds 21. Gas under pressure is fed from the manifolds 21 to the injectors 11.

In operations of the furnaces illustrated in FIG. 6 and 7 metal strip is admitted to the furnace through the entry seal 17 and is supported on its passage through the furnace chamber above the lips 27 on cushions of gas supplied from the plenum chamber 24. In turn the plenum chamber is supplied with gas under pressure from the injectors 11. The gas jets issuing from the injectors 11 induce gas already present in the furnace to flow through the passage 23 into the plenum chambers 24. As indicated by arrows in FIG. 7, the gas from the plenum chamber 24 passes between the opposed surfaces of the lips 27 and the strip 1 and is caused to recirculate via a side passage 32 back to the vicinity of the injectors 11 to be returned to the plenum chamber 24.

A portion of the recirculating gas is withdrawn from the furnace through the ducting 29, is cooled and then compressed, dried and heated before being returned to the furnace by the injector manifolds 21.

In treatments in which the mass of gas required to provide the heat to raise the strip to the required temperature and at the same time to support the strip during its passage through the furnace are mutually compatible, no additional heat source other than the heat energy contained in the gas will be required. Thus, in the furnace illustrated, the entire heat energy input to the gas may be derived from the heaters 10 the heater elements 28 either being removed or switched off. In other treatments however, where the throughput of strip through the furnace is large and/or when the desired strip temperature is in excess of the gas temperature, additional sources of heat are required. In these cases, the electrical resistance heating elements 28 or gas fired radiant tubes located within the furnace chamber provide direct radiation heating to the strip. This situation arises when sintering strip made by roll compaction of metal powders, where the desired temperatures may in the case of stainless steels fall within the range 1000° to 1400 C.

It will be appreciated that use of the injectors 11 promotes rapid recirculation of the gases within the furnace to provide the large volume of gas required to support and heat the strip within the furnace both economically and practicably. These criteria are of particular importance when the nature of the strip being heat treated requires a furnace atmosphere which is relatively expensive. For example, stainless steel strip made by roll compacting stainless steel powder can advantageously be sintered in atmospheres composed of mixtures of argon and hydrogen by employing injectors to feed the support gas into the lower part of the furnace chamber, the mass of gas delivered to the plenum chamber 24 being increased by virtue of the induced internal recirculation by a factor of between 2:1 and 6:1 compared with the mass of gas fed to the injectors. Further significant economies are achieved by recirculating a proportion of the gas after it has passed over the strip externally of the furnace to the blower compressor 9 for re-injection to the furnace.

We claim:

1. A furnace for the heat treatment of metal strip comprising a furnace chamber with heating means having an internal wall structure defining a flow path for gas recirculating internally within the chamber, a strip support surface extending lengthwise through the furnace chamber, a plurality of injectors in communication with a source of gas under pressure located externally of said chamber and operably connected with the furnace to place the interior of the furnace chamber under pressure to promote internal recirculation of gas within the furnace chamber and means for directing recirculating gas over the strip support surface to provide a gaseous cushion between said surface and metal strip travelling through the furnace.

2. A furnace as claimed in claim 1 wherein the strip support surface extends along the full length of the furnace chamber.

3. A furnace as claimed in claim 1 wherein the strip support surface comprises an apertured plate positioned immediately below the path to be taken by metal strip as it travels through the furnace, the internal wall structure being such that recirculating gas passes upwardly through the apertures of the plate into contact with the undersurface of strip travelling through the furnace chamber.

4. A furnace as claimed in claim 1 wherein the strip support surface comprises two substantially parallel members spaced apart by a distance less than the width of strip to be heat treated within the furnace.

5. A furnace as claimed in claim 4 wherein the members are inclined downwards at a small angle to the horizontal towards their inner edges.

6. A furnace as claimed in claim 1 wherein the strip support surface comprises outwardly inclined walls of a trough extending along substantially the full length of the furnace chamber, the internal wall structure being such that recirculating gas passes into the base of the trough and flows outwardly therefrom over the said inclined walls of the trough.

7. A furnace as claimed in claim 1 wherein the lower portion of the furnace chamber is divided into several compartments by spaced transverse vertical walls having upper edges which terminate below the path to be taken by metal strip as it travels through the furnace.

8. A furnace as claimed in claim 1 wherein a minor proportion of the gas recirculating within the furnace chamber is withdrawn from the chamber via external ducting, is conveyed by the ducting to a blower and is readmitted at a raised pressure to the furnace chamber through the injectors.

9. A furnace as claimed in claim 8 wherein gas withdrawn from the furnace chamber is heated as it passes between the blower and the injectors.

10. A furnace as claimed in claim 8 wherein a quantity of fresh gas is admitted to the blower means in order to make up for gas escaping from the furnace.

11. A furnace as claimed in claim 8 wherein a single blower means is provided to feed gas under pressure to all injectors.

12. A furnace as claimed in claim 8 wherein the blower means comprises a plurality of individual blowers connected one to feed each injector.

13. A furnace as claimed in claim 1 further comprising a plurality of electric heating elements mounted within the furnace chamber to heat the recirculating gas.

14. A furnace for the continuous heat treatment of metal strip comprising a furnace chamber having an internal wall structure defining a flow path for gas recirculating internally within the chamber, a trough extending along substantially the full length of the furnace chamber and including a base and divergent side walls extending upwardly from the base which define strip support surfaces for strip travelling through the furnace chamber, a plurality of injectors operable to place the interior of the furnace chamber in communication with a source of gas under pressure to promote internal recirculation of gas within the furnace chamber, and means for directing recirculating gas into the trough whereby said gas flows upwardly over the side walls of the trough to provide a gaseous cushion between said walls and metal strip travelling through the furnace.

15. A furnace as claimed in claim 14 wherein the injectors extend through the side walls of the furnace chamber at locations immediately upstream of the means for directing recirculating gas into the trough.

16. A furnace as claimed in claim 14 wherein the internal wall structure includes an upstanding partition member extending lengthwise of the furnace chamber to one side of the trough to define with one side wall of the furnace chamber, a channel for directing recirculating gas to the base of the trough.

* * * * *